US008659480B2

(12) United States Patent
Wilkins

(10) Patent No.: US 8,659,480 B2
(45) Date of Patent: Feb. 25, 2014

(54) APPARATUS AND ASSOCIATED METHOD FOR PROVIDING A FREQUENCY CONFIGURABLE ANTENNA EMPLOYING A PHOTONIC CRYSTAL

(75) Inventor: Donald Frank Wilkins, O'Fallon, MO (US)

(73) Assignee: The Boeing Company, Chicago, IL (US)

( * ) Notice: Subject to any disclaimer, the term of this patent is extended or adjusted under 35 U.S.C. 154(b) by 611 days.

(21) Appl. No.: 12/774,438

(22) Filed: May 5, 2010

(65) Prior Publication Data

US 2011/0273347 A1 Nov. 10, 2011

(51) Int. Cl.
*H01Q 1/38* (2006.01)
*H01Q 9/14* (2006.01)

(52) U.S. Cl.
USPC ..... 343/700 MS; 343/724; 343/823; 343/868; 343/876

(58) Field of Classification Search
USPC ..... 343/700 MS, 702, 749, 846, 841, 909, 343/724, 823, 828, 868, 876
See application file for complete search history.

(56) References Cited

U.S. PATENT DOCUMENTS 5,541,614 A * 7/1996 Lam et al. ..... 343/792.5
6,198,438 B1 3/2001 Herd et al.
6,898,358 B2 * 5/2005 Li et al. ..... 385/122
8,081,117 B2 * 12/2011 Nagai et al. ..... 343/700 MS
2007/0257853 A1 11/2007 Gevorgian et al.
2008/0036664 A1 2/2008 Haziza
2009/0303128 A1 12/2009 Robert et al.

OTHER PUBLICATIONS

U.S. Appl. No. 12/542,192 dated Aug. 17, 2009, First named inventor: Wilkins.
Joannopoulos, J.D. et al., *Photonic Crystals: Molding the Flow of Light*, Princeton University Press, Princeton and Oxford (2008) pp. 1-305.
Weedon, W.H. et al., *MEMS-switched reconfigurable antennas*, Proceedings of the IEEE AP-S International Symposium, Antennas and Propagation (2001) pp. 654-657.
Yang, S. et al., *A Novel Reconfigurable Maze Antenna for Multi-service Wireless Universal Receivers*, Proceedings of the IEEE Radio and Wireless Symposium (2006) pp. 195-198.
Yang, S. et al., *Frequency-Reconfigurable Antennas for Multiradio Wireless Platforms*, IEEE Microwave Magazine (2009) pp. 66-83.
*RF MEMS*[online] [retrieved Apr. 10, 2013] <URL: http://en.wikipedia.org/wiki/RF_MEMS> pp. 1-11.
Extended European Search Report for Application No. 11164877.0; dated Dec. 4, 2013.

* cited by examiner

*Primary Examiner* — Michael C Wimer
(74) *Attorney, Agent, or Firm* — Alston & Bird LLP

(57) ABSTRACT

A frequency reconfigurable antenna may include at least two antenna segments and a photonic crystal positioned between the at least two antenna segments. The photonic crystal may selectably electrically connect or isolate the at least two antenna segments with respect to each other based on a conductive state of the photonic crystal.

16 Claims, 4 Drawing Sheets

APPARATUS AND ASSOCIATED METHOD FOR PROVIDING A FREQUENCY CONFIGURABLE ANTENNA EMPLOYING A PHOTONIC CRYSTAL

TECHNOLOGICAL FIELD

Embodiments of the present disclosure relate generally to methods and apparatus controllably configuring an antenna to receive and/or transmit electromagnetic signals and, more particularly, to methods and apparatus for employing a photonic crystal for controllably configuring an antenna to receive and/or transmit electromagnetic signals of selectable frequencies.

BACKGROUND

Modern aircraft include a number of different communications systems. These systems may include, for example, public cabin Wi-Fi connectivity systems, crew information systems, wireless passenger service units, wireless passenger control units, wireless emergency lighting systems, commercial mobile radio services, and the like. Some wireless systems may operate using a single frequency. However, other wireless communication systems may operate over multiple frequencies. To support operations over multiple frequencies and perhaps also to support multiple different systems, aircraft and numerous other vehicles or devices with robust communication capabilities may employ a corresponding number of radios. As such, some of the above mentioned devices may essentially be multiradio platforms. To support the multiple radios, corresponding multiple antennas may be employed in some cases. In other cases, multiband or wideband antennas may be employed, while in still other cases, frequency reconfigurable antennas may be employed to support the above mentioned multiradio platforms.

Other multiradio platforms include smart phones, laptop computers, mobile Internet devices, and the like. Many of these smaller devices have limited space and parameters such as cost, space and weight considerations may be influential design factors. Even in larger scale devices such as aircraft, cost, weight and complexity savings may be appreciable on a single aircraft, and as aggregated over a fleet of aircraft. Therefore, it may be undesirable to employ a plurality of individual antennas, or bulky and complicated multiband or frequency reconfigurable antennas.

Accordingly, it may be desirable to provide an antenna that may overcome some of the disadvantages described above.

BRIEF SUMMARY

Some embodiments of the present disclosure may provide a frequency reconfigurable antenna that employs multiple elements and a photonic crystal as a switching device positioned between antenna elements. The photonic crystal may have electrically alterable states that can either deflect or pass electromagnetic radiation to thereby render the antenna element isolated or included to provide a frequency reconfigurable antenna. In some examples, a frequency configurable antenna with photonic crystals may be more economical, may consume less power and/or may require less complex management than at least some other types of frequency configurable antennas. Moreover, the frequency configurable antenna with photonic crystals may be incorporated in devices having a relatively small form factor, thereby increasing the variety of devices that may be serviced by the photonic crystal apparatuses according to embodiments of the present disclosure.

In one example embodiment, a frequency reconfigurable antenna is provided. The frequency reconfigurable antenna may include at least two antenna segments and a photonic crystal positioned between the at least two antenna segments. The photonic crystal may selectably electrically connect or isolate the at least two antenna segments with respect to each other based on a conductive state of the photonic crystal.

In another example embodiment, a frequency reconfigurable antenna control system is provided. The frequency reconfigurable antenna control system may include a frequency reconfigurable antenna and a switch controller. The frequency reconfigurable antenna may include at least two antenna segments and a photonic crystal positioned between the at least two antenna segments. The photonic crystal may selectably electrically connect or isolate the at least two antenna segments with respect to each other based on a conductive state of the photonic crystal as provided by the switch controller.

The features, functions and advantages that have been discussed can be achieved independently in various embodiments of the present disclosure or may be combined in yet other embodiments, further details of which can be seen with reference to the following description and drawings.

BRIEF DESCRIPTION OF THE SEVERAL VIEWS OF THE DRAWING(S)

Having thus described the disclosure in general terms, reference will now be made to the accompanying drawings, which are not necessarily drawn to scale, and wherein:

DETAILED DESCRIPTION

Figure 1A:
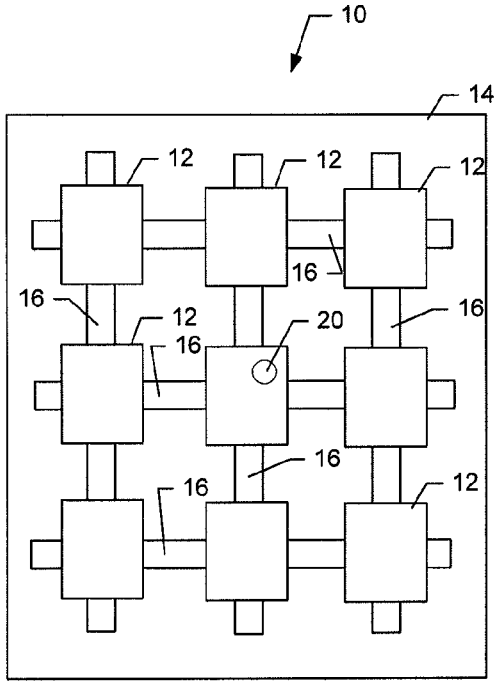
FIGS. 1A and 1B illustrate a frequency reconfigurable antenna according to an example embodiment.

The present disclosure now will be described more fully hereinafter with reference to the accompanying drawings, in which some, but not all embodiments are shown. Indeed, this disclosure may be embodied in many different forms and should not be construed as limited to the embodiments set forth herein; rather, these embodiments are provided so that this disclosure will satisfy applicable legal requirements. Like numbers refer to like elements throughout.

As discussed above, multiradio platforms may employ multiple individual antennas, multiband antennas or frequency reconfigurable antennas. Conventional embodiments of each of the antenna configurations listed above may typically have corresponding advantages and disadvantages. For example, typical single-band, dedicated antennas have superior performance attributes, but often occupy too much space (particularly for mobile or space critical platforms). Multiband antennas, which may address several bands or services simultaneously, are often affordable solutions, but may face some challenges. For example, on the antenna side, each wireless module may support multiple frequency bands of the same service, but may require multiple antennas for diversity.

Some may require as many as three antennas for multiple-input, multiple-output (MIMO) operation. Multiband antennas may also be difficult to employ in space limited environments. Furthermore, multiband antennas placed next to each other in close proximity may cause mutual interference between antennas due to multiband antennas having low out-of-band rejection characteristics. Multiband antennas may also require expensive and stringent filters to improve out-of-band rejection.

Frequency reconfigurable antennas typically have excellent inherent bandpass and out-of-band rejection without the need for additional filters. While frequency reconfigurable antennas can have higher order resonances, these resonances are typically far away from the operating band and are removed with much less selective, lower cost filters. Frequency reconfigurable antennas are also often equipped with switches that may be controlled, for example, by direct current (DC) bias signals. Toggling the switches between on and off states may reconfigure the antenna (e.g., by changing the effective length of the antenna) to support a discrete set of operating frequencies. In some embodiments of frequency reconfigurable antennas, PIN diodes, RF MEMS or other switching devices may be employed. PIN diodes require a DC bias current in the "on" state and therefore consume relatively large amounts of DC power. RF MEMS typically rely on metallic connections involving a mechanical movement within the switch that requires a relatively high actuating voltage (e.g., greater than 60V). RF MEMS switches may also yield relatively low switching speeds due to the mechanical nature of the switching mechanism. Additionally, RF MEMS are often expensive. Accordingly, some embodiments of the present disclosure may provide for a frequency reconfigurable antenna that employs photonic crystal switching elements between antenna segments.

Figure 1B:
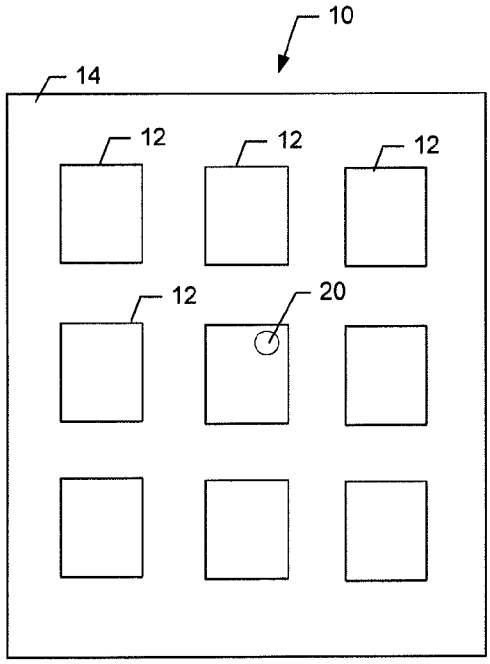

FIG. 1A and 1B illustrate an example of a frequency reconfigurable antenna 10 of an example embodiment. The example of FIGS. 1A and 1B is a patch antenna, but other types of frequency reconfigurable antennas may also employ embodiments of the present disclosure. Patch antennas are often characterized by having a wide beam angle of almost uniform radiation pattern at the broadside of the antenna. Patch antennas also may have inherent ground shields that improve specific absorption rate (SAR) compliance. Patch antennas typically employ a variety of slots that can detour current paths in the patch antenna to control resonances. The lengths of the slots can be controlled by using switches to reconfigure patch antenna operating frequency.

In the example of FIGS. 1A and 1B, a plurality of antenna elements are segments that may be selectably electrically connected to each other or isolated from each other to provide frequency reconfigurability. In this example of a patch antenna, the antenna segments may be considered patches. Accordingly, for example, a plurality of patches 12 may be disposed spaced apart from each other on a substrate 14. The number of patches 12 that are connected together may define the current path available to electromagnetic radiation received at or transmitted from the frequency reconfigurable antenna 10. In an example embodiment, switches 16 may be positioned on the substrate 14 between different patches 12 to connect patches 12 together when the switches are in an on state (as shown in FIG. 1A) or to isolate patches 12 when the switches 16 are in an off state (as shown in FIG. 1B). In some embodiments, the switches 16 may be photonic crystals as described in greater detail below.

In an example embodiment, the patches 12 may be disposed in a variety of different patterns and the switches 16 may be turned on and off separately, collectively, in groups, or according to various patterns as determined by the architecture employed. For example, in some cases, the switches 16 may be individually addressable to provide for the ability to select individual switches 16 to turn on or off to provide a plurality of selectable frequencies of operation corresponding to each possible different effective antenna length that is able to be produced. In other situations, all switches may be turned on or off together, which may essentially limit operation to two selectable frequencies (e.g., one in which all switches are on and another in which all switches are off). In still other examples, the switches 16 may be addressable in columns and rows such that entire columns (or rows) of switches 16 may be addressable together to turn on or off the switches 16 in the corresponding selected columns (or rows) to provide multiple different selectable operating frequencies. Thus, there may be significant flexibility provided with respect to the ability to provide frequency configuration for desirable frequencies.

In some cases, a coaxial feed 20 or some other input/output port may be in electrical communication with one of the patches 12. Accordingly, signals may be fed into or out of the coaxial feed 20 to provide an input/output interface for the frequency reconfigurable antenna 10. The operating frequencies of the frequency reconfigurable antenna 10 may be determined by the architecture of the patch layout in consideration of the switch 16 positions that are employable. Operating frequencies may be selected to cover multiple frequencies within a single spectral band or across multiple spectral bands. Thus, for example, the frequency reconfigurable antenna 10 could be configured to dynamically support L band (1-2 GHz) operation and X band (8-12.5 GHz) operation based on switch positions. Numerous other operating frequency arrangements are also possible.

FIGS. 2A, 2B, 2C and 2D illustrate an example of another frequency reconfigurable antenna 30. The example embodiment of FIGS. 2A, 2B, 2C and 2D is a wire antenna. Wire antennas may be constructed using a given arrangement of conductive wires located away from the ground plane. Basic wired antenna structures include monopole antennas, dipole antennas and loop antennas. Wire antennas typically offer wider bandwidths as compared to microstrip line antennas, which are generally constructed above a large ground plane.

For a wire antenna, the resonant frequency is primarily defined by the length or perimeter of wire that is electrically connected together to define the frequency reconfigurable antenna 30. A monopole antenna has its first resonance when its length is about a quarter-wavelength, while a loop antenna resonates at a frequency at which its perimeter is approximately one wavelength. Wire antennas can often be built in a relatively small volume and are useful in mobile platforms with relatively small ground planes. For a frequency reconfigurable wire antenna, the operating frequency may be selected by adding or removing parts of the length or perimeter of the antenna by using switches at the junctions or nodes that define intersections between wire segments.

Figure 2A:
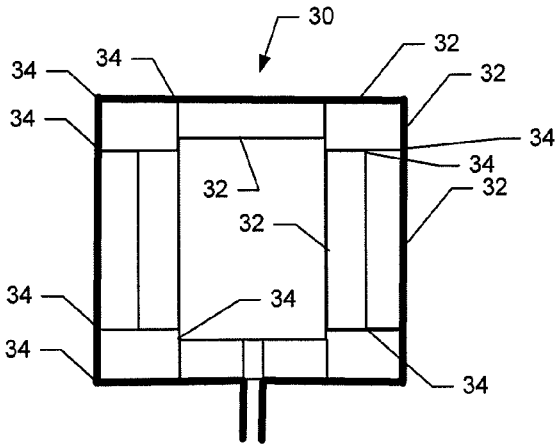
FIGS. 2A, 2B, 2C and 2D illustrate an alternative example of a frequency reconfigurable antenna according to another example embodiment.

FIG. 2A illustrates an example of a wire antenna in which a plurality of wire segments 32 (each of which are examples of antenna segments) are disposed in an array with switch nodes 34 positioned therebetween. The conduction states of the switch nodes 34 may be selectably altered in order to modify the effective length of the frequency reconfigurable antenna 30 based on the states of the switch nodes 34. In the example of FIG. 2A, switch nodes 34 positioned along the outer perimeter of the frequency reconfigurable antenna 30 may be configured to conduct along the outer perimeter and therefore connect all wire segments that define the outer perimeter of the frequency reconfigurable antenna 30. Meanwhile, switch nodes 34 that are positioned at interior portions of the frequency reconfigurable antenna 30 may not be configured to conduct. Accordingly, the segments highlighted in bold in FIG. 2A may be electrically connected to define the length of the frequency reconfigurable antenna 30.

Figure 2B:
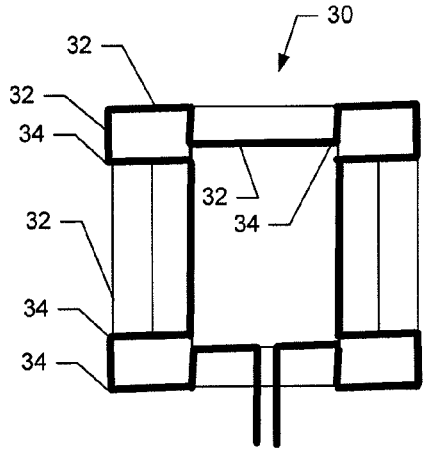
Figure 2C:
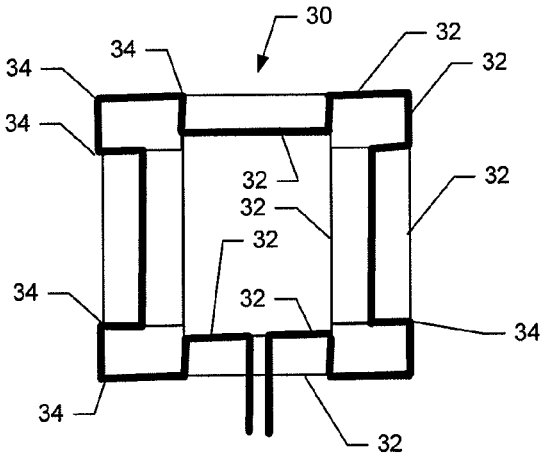
Figure 2D:
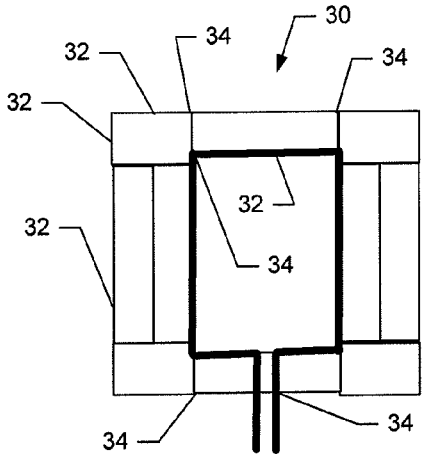

FIG. 2B illustrates an alternative example in which the length of the frequency reconfigurable antenna 30 is extended and therefore the operating frequency of the antenna is also correspondingly modified. In this example switch nodes 34 at intersections between the bold highlighted sections may be on (e.g., conductive) in order to connect the corresponding wire segments 32 to define the overall length of the frequency reconfigurable antenna 30. The example of FIG. 2C provides an even longer overall length of the frequency reconfigurable antenna 30. Meanwhile, the example of FIG. 2D provides for only interior switch nodes 34 to be on and corresponding interior wire segments 34 to therefore be selected to define the operating frequency of the frequency reconfigurable antenna 30. Again in FIGS. 2C and 2D, the bold highlighted wire segments 32 indicate those segments that are electrically connected to each other to define the length of the frequency reconfigurable antenna 30.

Figure 3A:
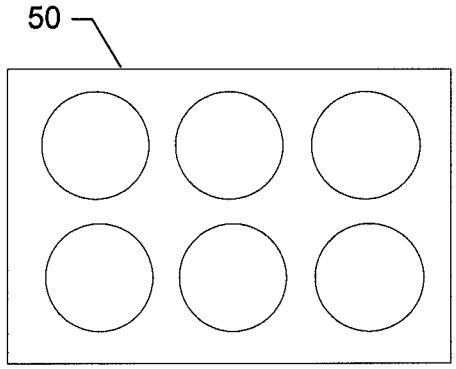
FIGS. 3A and 3B illustrate conductive states of a photonic crystal in accordance with an example embodiment.
Figure 3B:
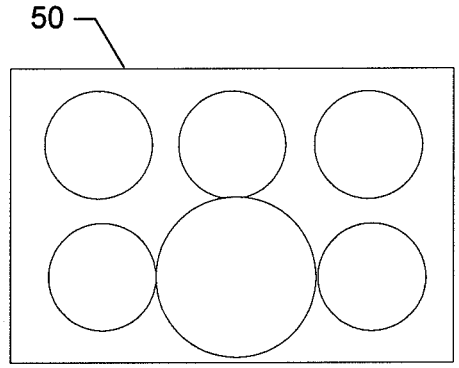

FIGS. 3A and 3B illustrate conductive states of a photonic crystal 50 in accordance with an example embodiment. The photonic crystal 50 may be a periodic optical nanostructure, such as a periodic dielectric or metallo-dielectric nanostructure. The photonic crystal 50 may have electrically alterable states that correspond to a changed dielectric constant of the material of the photonic crystal 50 that causes either passage of or deflecting of electromagnetic radiation. In an example embodiment, the photonic crystal 50 generally affects the propagation of electromagnetic signals in the same manner that the periodicity of a semiconductor crystal affects the electron motion by defining allowed and forbidden electronic energy bands. Photonic crystals may include regularly repeating internal regions having relatively high and relatively low dielectric constants.

The photonic crystal 50 may be configured to block electromagnetic radiation (e.g., microwaves) when the photonic crystal is in an undistorted state as shown in FIG. 3A. Meanwhile, the photonic crystal 50 may be configured to receive electromagnetic signals and direct the electromagnetic signals along a predefined path through the photonic crystal 50 when the photonic crystal 50 is in a distorted state as shown in FIG. 3B. As such, the photonic crystal 50 may be considered to be "off" or in an off state when the photonic crystal 50 is in the undistorted state and "on" or in an on state when the photonic crystal 50 is in the distorted state.

The photonic crystal 50 can define a path for electromagnetic radiation to pass through the photonic crystal 50 in various manners. In one embodiment, the photonic crystal 50 defines a hole or open passageway that extends through the photonic crystal 50 so that the electromagnetic signals preferentially propagate through the hole or open passageway. Alternatively, the photonic crystal 50 may include a rod that extends through the photonic crystal 50 and defines the path therethrough. In this regard, the rod may be constructed in such a manner that electromagnetic signals preferentially propagate along or through the rod.

In an example embodiment, the photonic crystal 50 of FIGS. 3A and 3B may be an example of one of the switches 16 of FIG. 1A or one of the switch nodes 34 of FIGS. 2A, 2B, 2C or 2D. As such, the photonic crystal 50 may be enabled to link antenna elements or segments together or isolate such elements or segments based on the state of the photonic crystal 50. In this regard, for example, if the photonic crystal 50 is on, the photonic crystal 50 may link adjacent antenna segments that are connected thereto to permit energy (e.g., electromagnetic radiation) to be conducted between the adjacent antenna segments. However, if the photonic crystal 50 is off, the photonic crystal 50 may isolate adjacent antenna segments from each other to prevent energy (e.g., electromagnetic radiation) from being conducted between the adjacent antenna segments via the photonic crystal 50. The geometry of connected antenna segments may then determine the selected frequency of the resulting antenna.

Although not always the case, in some embodiments, the photonic crystal 50 may be built from a piezoelectric crystal with holes drilled in the material or with some other form of mechanical deformation provided thereto in order to influence characteristics of the material. When a bias current is not applied to the photonic crystal 50 (or current below a particular threshold is applied), the photonic crystal 50 may remain undistorted and not conduct electromagnetic radiation in the off state. However, when bias current is applied to the photonic crystal 50 (or current above a particular threshold), the photonic crystal 50 may be distorted and conduct electromagnetic radiation in the on state. Application of the bias current may be controlled by a switch control circuit as shown in FIG. 4 below.

Figure 4:
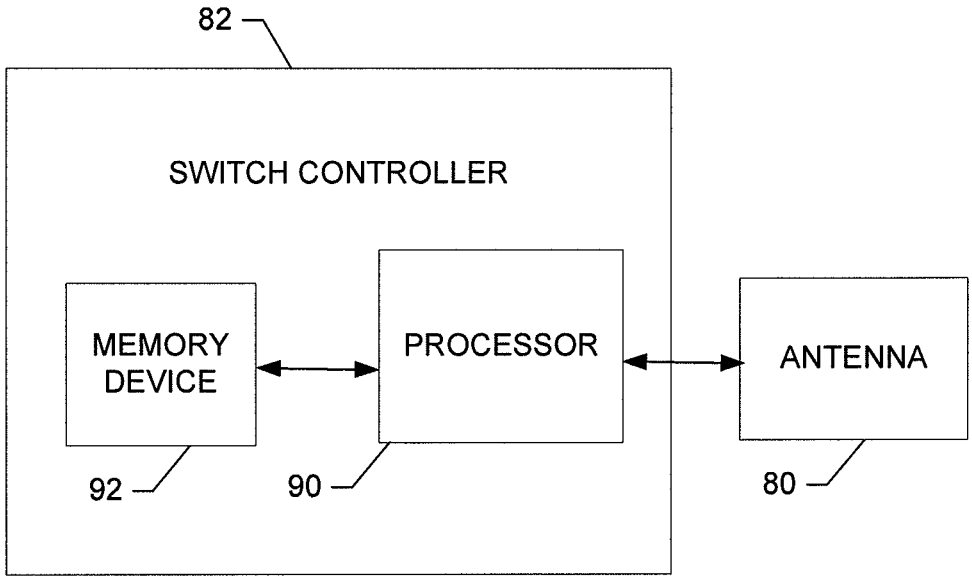
FIG. 4 illustrates a block diagram of a frequency reconfigurable antenna control system according to an example embodiment.

FIG. 4 illustrates a block diagram of a frequency reconfigurable antenna control system according to an example embodiment. As shown in FIG. 4, the frequency reconfigurable antenna control system may include a frequency reconfigurable antenna 80 and a switch controller 82. The switch controller 82 may, in some embodiments, include a processor 90 and memory 92. The memory 92 may include volatile and/or non-volatile memory (e.g., non-transitory memory) that may store instructions for execution by the processor 90 to carry out functionality associated with the switch controller 82. However, in some embodiments, the processor 90 may be an application specific integrated circuit (ASIC) or field programmable gate array (FPGA) that is specifically configured to perform switch selection based on directions received thereat (either from a user or from another device providing radio and/or frequency selection). As such, although not shown, the switch controller 82 may include or be in communication with a radio interface for providing circuitry and corresponding hardware and/or software for enabling the switch controller 82 to interface with various radios that may operate over different selectable frequency bands (e.g., receiver circuitry, decoders/encoders (if applicable) and corresponding signal processing circuitry). In some cases, the switch controller 82 may also include or be in communication with a user interface to enable the user to select specific radios or frequencies for operation of the frequency reconfigurable antenna control system.

The switch controller 82 may be configured to enable selection of switches (e.g., switches 16 or switch nodes 34) that are to be turned on or off in order to select a specific antenna architecture and therefore a corresponding radio or operating frequency. In some embodiments, the switch controller 82 may be enabled to (e.g., via a series of gates, transistors, or other selection circuitry) provide bias currents to selected ones of a matrix of control lines. Each control line may be electrically coupled to a corresponding switch or group of switches in order to, when selection of the corresponding switch or group of switches is indicated, apply a biasing current to the selected switch or group of switches. The switch or group of switches to which biasing current is applied may then turn on in order to distort the corresponding photonic crystal(s) associated with the respective antenna segments between which the photonic crystal(s) is (are) located. In response to distortion of the photonic crystal(s), the photonic crystal(s) may discontinue blocking of electromagnetic radiation and may effectively connect the antenna segments to each other. When the matrix of control lines is managed by the switch controller 82 in accordance with desired radio or frequency selections, characteristics (e.g., effective length) of the frequency reconfigurable antenna associated with the switch controller 82 may be controlled in order to configure the frequency reconfigurable antenna as desired.

Many modifications and other embodiments of the disclosure set forth herein will come to mind to one skilled in the art to which these embodiments pertain having the benefit of the teachings presented in the foregoing descriptions and the associated drawings. Therefore, it is to be understood that the disclosure is not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A frequency reconfigurable antenna comprising:

at least two antenna segments; and a photonic crystal positioned between the at least two antenna segments to selectably electrically connect or isolate the at least two antenna segments with respect to each other based on a conductive state of the photonic crystal, wherein the photonic crystal is configured to act as a switch and is further configured to have an on state in which the photonic crystal has a distorted state that electrically connects the at least two antenna segments by passing electromagnetic radiation therethrough and an off state in which the photonic crystal has an undistorted state that electrically isolates the at least two antenna segments by blocking electromagnetic radiation, wherein the photonic crystal has a dielectric constant that changes between the distorted and undistorted states, and wherein the photonic crystal is responsive to a biasing current applied thereto and is configured to be off in the undistorted state responsive to an absence of the biasing current being applied to the photonic crystal and wherein the photonic crystal is on in the distorted state responsive to the biasing current being applied to the photonic crystal.

2. The frequency reconfigurable antenna of claim 1, wherein the at least two antenna segments are each patches of a patch antenna.

3. The frequency reconfigurable antenna of claim 1, wherein the at least two antenna segments are each wire segments of a wire antenna.

4. The frequency reconfigurable antenna of claim 1, further comprising a plurality of antenna segments having photonic crystals disposed between each adjacent antenna segment; wherein adjacent antenna segments are connectable or isolable from each other based on whether a respective photonic crystal disposed therebetween is on or off.

5. The frequency reconfigurable antenna of claim 4, wherein individual ones of the photonic crystals are controllable independent of each other.

6. The frequency reconfigurable antenna of claim 4, wherein the photonic crystals are controllable in groups selected based on a conductive state of a plurality of control lines.

7. A frequency reconfigurable antenna control system comprising:

a frequency reconfigurable antenna; and a switch controller, wherein the frequency reconfigurable antenna includes at least two antenna segments and a photonic crystal positioned between the at least two antenna segments to selectably electrically connect or isolate the at least two antenna segments with respect to each other based on a conductive state of the photonic crystal as provided by the switch controller, and wherein the photonic crystal is configured to act as a switch and is further configured to have an on state in which the photonic crystal has a distorted state that electrically connects the at least two antenna segments by passing electromagnetic radiation therethrough and an off state in which the photonic crystal has an undistorted state that electrically isolates the at least two antenna segments by blocking electromagnetic radiation, wherein the photonic crystal has a dielectric constant that changes between the distorted and undistorted states, and wherein the photonic crystal is responsive to a biasing current applied thereto and is configured to be off in the undistorted state responsive to an absence of the biasing current being applied to the photonic crystal and wherein the photonic crystal is on in the distorted state responsive to the biasing current being applied to the photonic crystal.

8. The frequency reconfigurable antenna control system of claim 7, wherein the at least two antenna segments are each patches of a patch antenna.

9. The frequency reconfigurable antenna control system of claim 7, wherein the at least two antenna segments are each wire segments of a wire antenna.

10. The frequency reconfigurable antenna control system of claim 7, wherein the frequency reconfigurable antenna comprises a plurality of antenna segments having photonic crystals disposed between each adjacent antenna segment; wherein adjacent antenna segments are connectable or isolable from each other based on whether a respective photonic crystal disposed therebetween is on or off.

11. The frequency reconfigurable antenna control system of claim 10, wherein individual ones of the photonic crystals are controllable independent of each other.

12. The frequency reconfigurable antenna control system of claim 10, wherein the photonic crystals are controllable in groups selected based on a conductive state of a plurality of control lines.

13. The frequency reconfigurable antenna control system of claim 7, wherein the switch controller comprises a matrix of control lines and wherein the switch controller is configured to energize selected control lines in electrical communication with corresponding photonic crystals to change a distortion state of the corresponding photonic crystals from an undistorted state to a distorted state.

14. The frequency reconfigurable antenna control system of claim 13, wherein the switch controller comprises a processor and memory, and wherein the memory stores instructions executable by the processor to control operation of the switch controller with respect to selection of control lines.

15. The frequency reconfigurable antenna control system of claim 13, wherein the switch controller is configured to select groups of photonic crystals for distortion state changes via the control lines.

16. The frequency reconfigurable antenna control system of claim 7, wherein the frequency reconfigurable antenna is configured to operate with multiple radios.

* * * * *